US005782699A

United States Patent [19]

Harrap

[11] Patent Number: 5,782,699

[45] Date of Patent: Jul. 21, 1998

[54] STEERABLE SWINGING DEVICE

[76] Inventor: Neil Horace Harrap, 11 St Mary Street, Thorndon, Wellington, New Zealand

[21] Appl. No.: 696,940

[22] PCT Filed: Feb. 22, 1995

[86] PCT No.: PCT/NZ95/00019

§ 371 Date: Aug. 22, 1996

§ 102(e) Date: Aug. 22, 1996

[87] PCT Pub. No.: WO95/22385

PCT Pub. Date: Aug. 24, 1995

[30] Foreign Application Priority Data

Feb. 22, 1994 [NZ] New Zealand ..... 250943

[51] Int. Cl.[6] ..... A63G 9/12

[52] U.S. Cl. ..... 472/118; 472/133

[58] Field of Search ..... 472/118, 119, 472/124, 133, 136, 137, 130

[56] References Cited

U.S. PATENT DOCUMENTS

| | | | |
|---|---|---|---|
| 1,422,032 | 7/1922 | Chapman . | |
| 1,446,031 | 8/1923 | Rippin . | |
| 1,925,180 | 9/1933 | Eyerly | 472/130 X |
| 4,898,377 | 2/1990 | Roche | 472/130 |
| 5,527,223 | 6/1996 | Kichen et al. | 472/118 |
| 5,573,465 | 11/1996 | Kitchen et al. | 472/118 |

FOREIGN PATENT DOCUMENTS 94 13 157.0 10/1994 Germany .

OTHER PUBLICATIONS

European Search Report dated Sep. 28, 1997.

*Primary Examiner*—Kien T. Nguyen
*Attorney, Agent, or Firm*—McDermott, Will & Emery

[57] ABSTRACT

A steerable swing device is disclosed which comprise support cables (3, 4) strung across a gully and crossed to form a junction (9). The support cables are anchored at the sides of the gully by anchor points (5, 6, 7, 8). A swing cable (2) is suspended below junction (9) and a craft (1) is suitably attached to the swing cable. A motor-driven winch drum (13) is positioned at the top of the gully and functions to winch the craft to a desirable height before releasing the craft to commence the swing. The craft carries a rider and is provided with a tail assembly including a rudder (18) which is adjusted by moving a joystick (19). During the swing, the craft moves laterally by a rider adjusting the rudder.

13 Claims, 6 Drawing Sheets

STEERABLE SWINGING DEVICE

TECHNICAL FIELD

This invention relates to a swing. More particularly, but not exclusively, this invention relates to a swinging device suspended below a substantially horizontally extending cable or bridge and designed to support a passenger in a steerable craft which swings about the cable or bridge.

BACKGROUND OF THE INVENTION

Various forms of swinging and hanging devices have been designed to provide excitement to passengers in the form of "ground rush" and the feel of centrifugal force on the body. For example, a conventional swing generally comprises one or two cables and is connected to a support structure and is provided with a seat to support a person. A disadvantage with the conventional swing is that it requires energy and power to be able to swing. Also, there in a limit to the height above ground over which a person can swing of about 15 meters. Furthermore, a conventional swing does not allow a person to control the path of the swing but merely permits a person to swing back and forth.

Another form of amusement is a bungy jump. An elastic cord is attached at one end to a person's ankles and anchored to a bridge or crane at the other end. The person jumps off the bridge or crane at a predetermined height above the ground or water, and falls generally vertically and subsequently bounces up and down before settling in a hanging position. The person feels the effects of free fall and "ground rush". However, there are limitations and disadvantages with bungy jumping in that a participant is not able to perform aerobatic manoeuvres and is not able to control the direction of travel after jumping.

DISCLOSURE OF THE INVENTION

It in an object of the invention to provide a steerable swinging device which overcomes at least some of the abovementioned problems, or at least to provide the public with a useful choice.

According to one aspect of the invention, there is provided a steerable swing device for swinging a rider attached to a carrier through the air for amusement, the steerable swing device comprising:

- a support means extending between at least two anchor points positioned substantially opposite each other at a height above the ground;
- a swing cable suspended vertically from the support means at a position approximately midway between the at least two anchor points;
- a carrier adapted to support a rider during a ride; the carrier attached to the lower end of the swing cable; and
- a reposition system adapted to reposition the carrier to a height above the ground suitable for release of the carrier at the start of a ride;
- the carrier being provided with control means operable by the rider during the ride such that the rider is able to control the direction of lateral movement of the carrier during the ride by steering the carrier during the ride as the carrier swings from its launch position about the support means.

Preferably the support means extends substantially horizontally between two anchor points. However, the support means may be in the form of an arc. It could comprise a cable or a bridge. The swinging device may comprise two support cables which meet at a junction point approximately midway along their length. The swing cable may extend downwardly from this midway point.

Preferably the steerable swing device comprises two lateral supports, extending downwardly from the horizontal support means, the upper end of each of the two lateral supports being joined to the horizontal support means and the lower end of each of the two lateral supports being joined to the lower part of the swing cable or the carrier itself. However, four lateral supports may be provided.

Preferably the carrier comprises a tail and rudder, the rudder being controllable by the rider during the ride or flight. The carrier may be in the form of a small aircraft in which a rider sits or in the form of a streamlined board, on which a rider may lie in a prone position on his or her stomach, head facing forward. A joystick to control the rudder may be provided for operation by the rider. Handles may also be provided.

Preferably the reposition system is a winch system which is adapted to winch the carrier up to a platform from which the carrier is launched at the start of a ride. The winch system may be adapted to lower the carrier to the ground after the ride has been completed.

The swing cable may be made of steel which may be stainless. Part of its length may be comprised of elasticated cord which may add further excitement to the ride.

The horizontal support cable may extend between two sides of a valley or gully or may extend between two towers. Alternatively the support means may be a bridge. A platform which may have steps may be provided to assist a rider to embark or disembark from the carrier when the carrier is resting at its lowest point.

It will be appreciated that a rider may enter the carrier at its lowest point and be subsequently raised to a launching position or the rider may enter the carrier when the carrier is resting at its launching position.

The invention also provides a method whereby a rider is launched from a height in a carrier and wherein the rider is able to control the lateral movement of the carrier during the subsequent flight or swing of the carrier.

BRIEF DESCRIPTION OF THE DRAWINGS

The invention will now be described by way of examples with reference to the accompanying drawings in which.

BEST MODE FOR CARRYING OUT THE INVENTION

Figure 1:
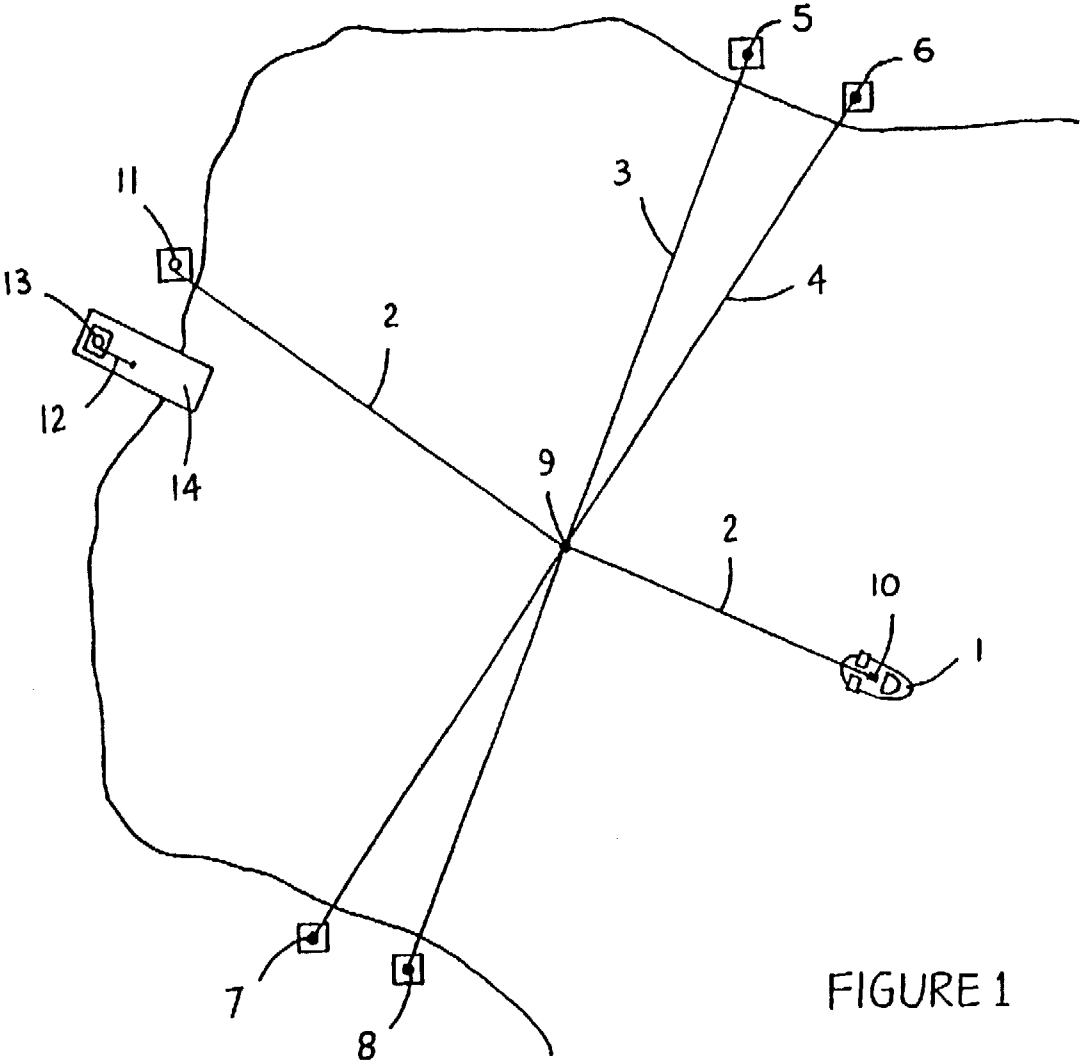
FIG. 1: shows a plan view of a steerable swinging device according to one embodiment of the invention.
Figure 2:
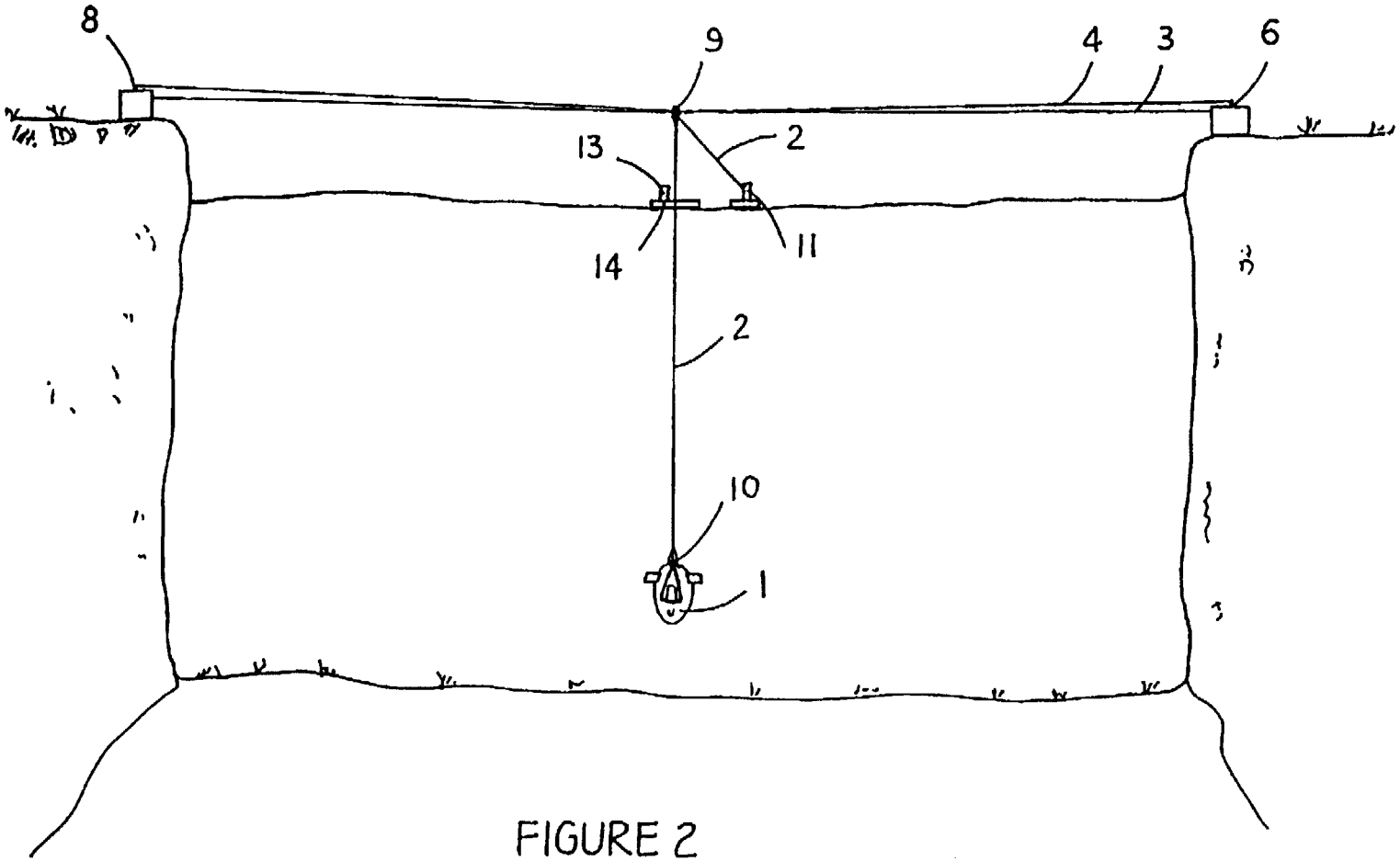
FIG. 2: shows a front view of the steerable swinging device according to one embodiment of the invention.
Figure 3:
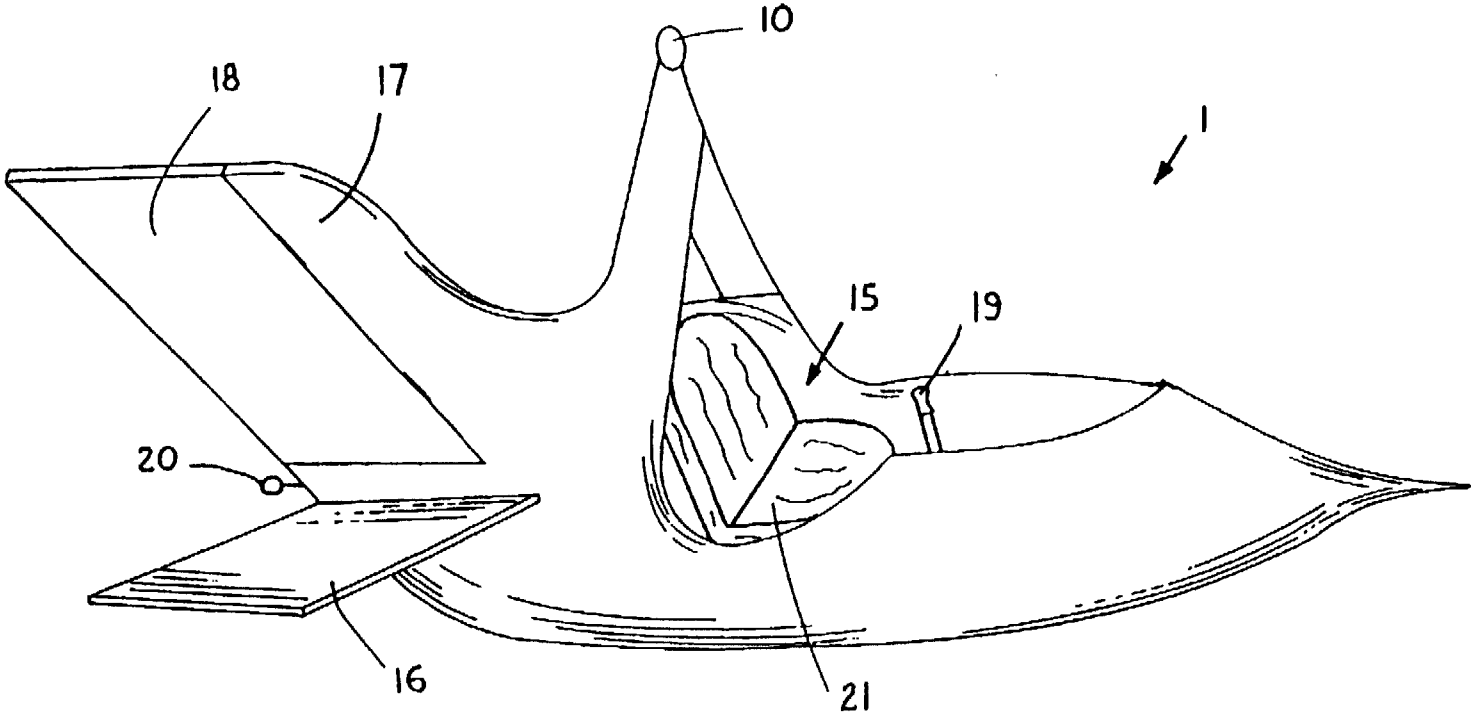
FIG. 3: shows a perspective view of a steerable craft.

Referring to FIGS. 1 to 3, a steerable swinging device constructed across a gully according to one embodiment of the invention is shown. Two support cables 3,4 are strung across the gully and crossed to form a junction point 9. The support cables 3,4 are anchored at the sides of the gully by anchor points 5,6,7, and 8. The construction of the support cables 3,4 provides a relatively stable anchor for the swing cable 2 attached at junction 9.

A craft 1 is connected to one end of a swing cable 2 by a universal joint 10 enabling the craft 1 to rotate about the swing cable 2. The swing cable 2 passes through a suitable pulley arrangement (not shown) attached at junction 9 and is attached around winch drum 11 adjacent a launching platform 14. A motor-driven winch drum 13 is positioned at the rear of the launching platform 14 and functions to winch the craft back to the platform 14 using winch cable 12 and secure the craft 1 during embarking of passengers into the craft.

All the cables are preferably constructed of a durable material such as stainless steel.

A craft 1 according to one embodiment is shown in FIG. 3. A passenger is restrained in the cockpit 15 of the craft 1 in seat 21 by suitable seatbelt means (not shown). The craft 1 is provided with a tail assembly consisting of tail planes 16 on both sides of a fin 17. The fin includes a rudder 18 which is controlled by operating a joystick 19. A hook 20 is attached to the craft 1 and is used to winch the craft 1 back to the platform 14 and to secure the craft 1 to the launching platform 14 after unloading and loading the craft with passengers.

The operation of this embodiment of the invention is now described. The craft is secured on the launching platform 14 by anchoring hook 20. A passenger embarks the craft 1 and is secured in the cockpit 15. The hook 20 is released and the passenger launches off the platform 14 and descends in an arc about junction 9. The passenger uses joystick 19 to operate the rudder 18 to steer the craft laterally. A passenger may carve figures of eight in the air and perform various aerobatic manoeuvres.

When the craft 1 ceases to swing, cable 2 is unloaded from winch drum 11 to lower the craft 1 to the ground. The passenger then disembarks. Winch cable 12 in lowered to the craft 1 and attached to hook 20 at the back of the craft 1. The craft 1 is then winched back to the platform 14, secured to the platform 14, and is ready for the next passenger.

A suitable height for the launching platform would be between about 50 to 150 meters from the lowest part of the swing. It will be appreciated that platform 14 need not be positioned normal to the cables 3,4 but may be offset.

It will also be appreciated that a passenger may embark the craft 1 when the swing cable is lowered adjacent the ground such as the base of the gully and the craft and passenger be winched to a suitable height in the air by winch cable 12 and released to swing. A platform 14 at the top of the gully is a preferred embodiment only.

Figure 4:
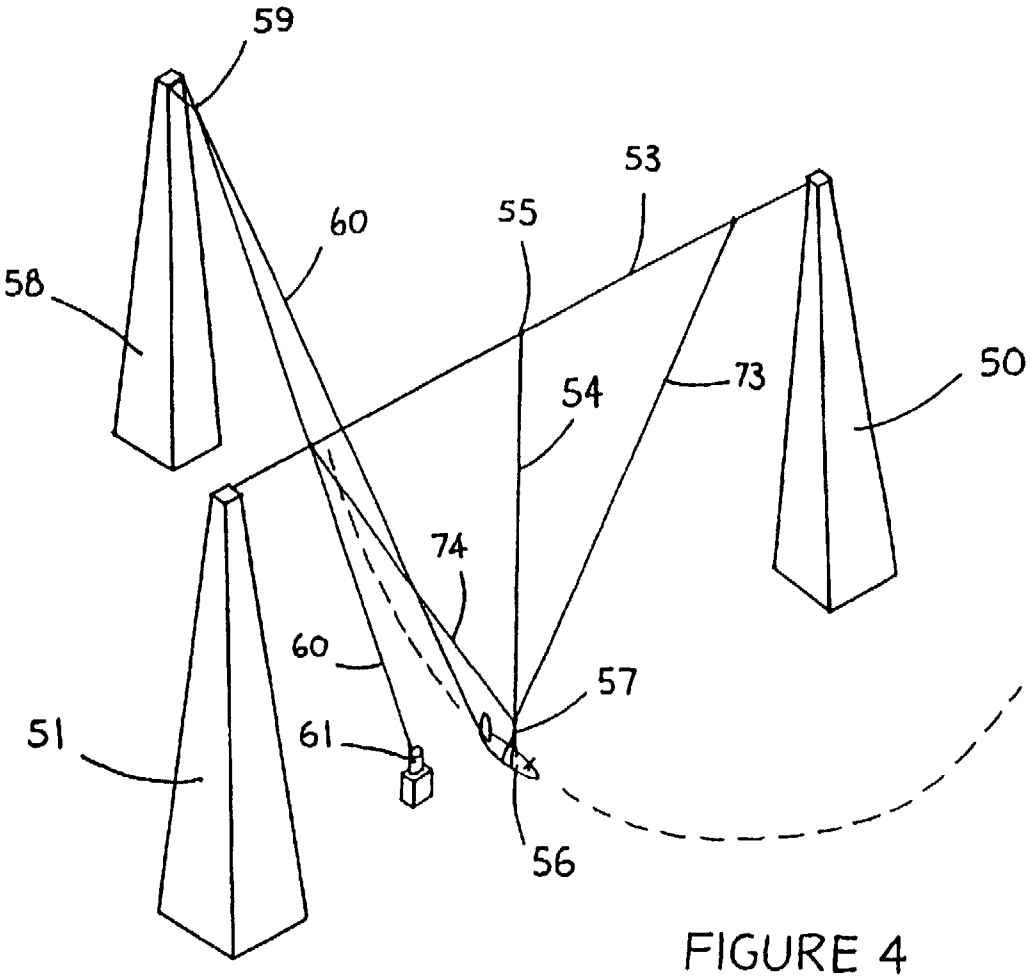
FIG. 4: shows the perspective view of a steerable swinging device according to an alternative embodiment of the invention.
Figure 5:
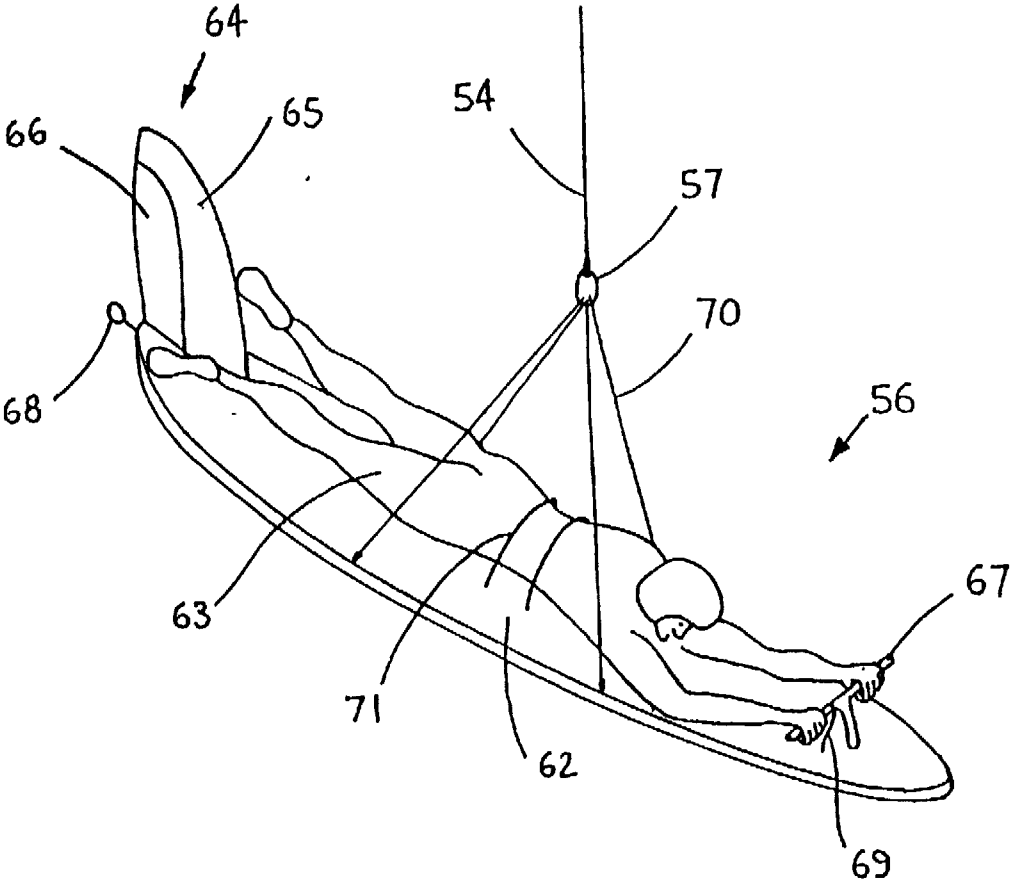
FIG. 5: shows a perspective view of a different type of steerable craft.
Figure 6:
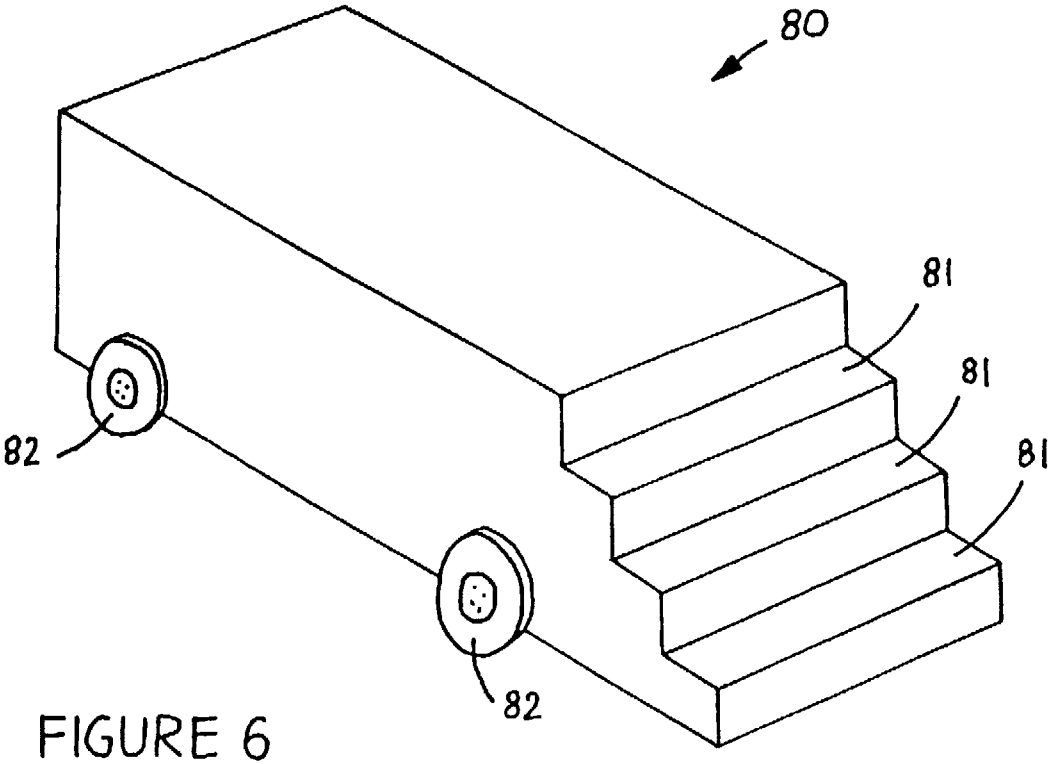
FIG. 6: shows a platform on wheels to assist with loading and unloading passengers in the steerable craft.

Referring now to FIGS. 4 to 6, an alternative embodiment of the steerable swinging device is shown. Two towers 50,51 are constructed at a predetermined height of at least about 50 meters. A support cable or rigid support beam provides a support arch 53 between the towers 50, 51. A swing cable 54 is suitably connected to the support arch 53 at junction 55. The lower end of the swing cable 54 is attached to a craft 56 by a universal joint 57.

Lateral cables 73, 74 are attached to the support arch 53 and are connected adjacent the lower end of the swing cable 54. These lateral cables 73,74 restrain the lateral movement of the craft 56 such that during swinging, one of the lateral cables is taut when the other is loose. It will be appreciated that the lateral cables 73, 74 may be an elastic cord or may be provided with a section of elastic cord to permit a varying degree of additional lateral movement of the craft 56 during the swing.

A winch system is constructed behind towers 50, 51 to winch the craft and passenger to a predetermined height above the ground. A pulley arrangement 59 is attached to the top of tower 58. A winch cable 60 is attached to winch drum 61 positioned underneath the junction 55 and passes through pulley arrangement 59 on tower 58 and is attached to hook 68 at the rear of the craft during winching.

Tower 58 is constructed to a predetermined height and distance relative to the height of junction 55. For example, if junction 55 is at a height of 50 meters, tower 58 may be constructed to a height of about 50 meters and about 55 meters from the junction 55.

Referring particularly to FIG. 5, a craft according to an alternative embodiment of the invention is shown. A craft 56 comprising a board 62 is shaped to comfortably retain a passenger 63 lying in a prone position along the board. The board is constructed with a tail assembly 64 comprising a tail 65 and steerable rudder 66.

Handlebars 67 are designed to be rotated by the passenger 63 to adjust the rudder 66 during the swing.

A hook 68 is attached to the rear of the craft 56 and is designed to retain the winch cable 60 and be released by the passenger squeezing release means 69. A suitable harness arrangement 70 to secure the craft to the swing cable 54 is provided. The passenger is secured to the board 62 for safety by fastening straps 71 attached to the board 62.

Referring now to FIG. 6, a platform designed to assist passengers embarking into and disembarking from the craft 56 is now described. The craft 56 is suspended on the swing cable 54 to about 2 meters above the ground for safety reasons. A platform 80 is designed to be wheeled underneath the suspended craft before launch and after the craft 56 is settled.

Steps 81 allow passengers to reach the top of the platform 80 and thus craft 56 with ease. Suitable wheels 82 are provided to position the platform 80 for loading and unloading, and to be removed away from the path of the swing during use.

The operation of this second embodiment of the invention is now described. The platform 80 is positioned under the craft 56. A passenger 63 is strapped to the board 62 by fastening straps 71. Winch cable 60 is attached to releasable hook means 68. The platform is wheeled away from the path of the swing and the craft 56 is winched by a motor (not shown) to a desirable height.

As the passenger 63 has control of the winch cable releasing means 69, he or she is able to choose at what height to release the winch cable 60 to commence the swing. The winch cable 60 may be retracted to the maximum height before being released by either the passenger 63 squeezing release means 69 or by the swing operators (not shown) below the junction 55.

When the winch cable 60 has been released, the craft 56 and passenger 63 swing about the junction 55. The direction of movement of the swing may be influenced by the passenger 63 adjusting the rudder 66 during the swing. This will move the craft 56 laterally. When the craft 56 has completed the swing, and is settled below junction 55, the platform 80 is wheeled beneath the craft 56 and the passenger 63 replaced. Winch cable 60 is attached to hook 68 and another thrilling swing commences.

Wherein the foregoing description reference has been made to specific components or integers having known equivalents then such equivalents shall herein be incorporated as if individually set forth.

Although this invention had been described by way of example and with reference to possible embodiments thereof it is to be understood that improvements and/or modifications may be made thereto without departing from the scope of the invention.

For example, it is not necessary to have two support cables 3,4. A single support cable could be used.

INDUSTRIAL APPLICATION

Although the various ways of constructing the steerable swinging device according to the invention will find application at a wide variety of places, the invention is considered particularly suitable at amusement parks and tourist resorts where people are generally seeking thrills and excitement.

I claim:

1. A steerable swinging device for swinging a rider attached to a carrier through the air for amusement, the steerable swing device comprising:

a support means extending between at least two anchor points, said anchor points positioned substantially opposite each other at a height above the ground and located respectively on support members that are spaced apart from each other;

a swing cable suspended vertically from the support means at a position approximately midway between at least two anchor points;

a carrier adapted to support a rider during a ride, the carrier attached to the lower end of the swing cable; and a reposition system adapted to reposition the carrier to a height above the ground suitable for release of the carrier at the start of a ride;

the carrier being provided with control means operable by the rider during the ride such that the rider is able to control the direction of lateral movement of the carrier during the ride as the carrier swings from its launch position about the support means.

2. A steerable swing device according to claim 1 in which the support means extend substantially horizontally between two anchor points above the ground.

3. A steerable swing device according to claim 1 in which the support means comprises a steel cable which extends horizontally between two upright support structures.

4. A steerable swing device according to claim 3 in which the upright support structures are towers.

5. A steerable swing device according to claim 1 further comprising two lateral supports, each lateral support extending downwardly from the support means, the upper end of each of the two lateral support means being joined to the support means and the lower end of each of the two lateral supports being joined to the lower part of the swing cable or to the carrier itself.

6. A steerable swing device according to claim 5 which comprises four lateral supports.

7. A steerable swing device according to claim 6 in which the carrier is in the form of a streamlined board, adapted to carrier a rider when the rider lies in a prone position on his or her stomach, head facing forward.

8. A steerable swing device according to claim 1 in which the carrier comprises a tail and rudder, the rudder being controllable by the rider during the rider or flight.

9. A steerable swing device according to claim 1 in which the repositioned system is a winch system which is adapted to winch the carrier up to a platform from which the carrier is launched at the start of a ride.

10. A steerable swing device according to claim 1, in which the swing cable is partly comprised of elasticated cord.

11. A steerable swing device for swinging a rider attached to a carrier through the air for amusement, the steerable swing device comprising:

a support means comprising two support cables extending between four anchor points positioned substantially opposite each other at a height above the ground, and which intercept at a junction point approximately midway along their length;

a swing cable suspended vertically from the junction point of the support cables;

a carrier adapted to support a rider during a ride, the carrier attached to the lower end of the swing cable; and a reposition system adapted to reposition the carrier to a height above the ground suitable for release of the carrier at the start of a ride;

the carrier being provided with control means operable by the rider during the ride such that the rider is able to control the direction of lateral movement of the carrier during the ride by steering the carrier during the ride as the carrier swings from its launch position about the support means.

12. A steerable swing device according to claim 11 further comprising two lateral supports, each lateral support extending downwardly from the support cables, the upper end of each of the two lateral supports means being joined to the support cables and the lower end of each of the two lateral supports being joined to the lower part of the swing cable or to the carrier itself.

13. A steerable swing device according to claim 12 which comprises four lateral supports.

* * * * *